United States Patent [19]

Gee et al.

[11] 4,140,071

[45] Feb. 20, 1979

[54] PROCESS FOR PREPARING TUFTED CARPET

[75] Inventors: John R. Gee, Newark, Del.; Ray M. Harlin, Hixson, Tenn.

[73] Assignee: E. I. Du Pont de Nemours and Company, Wilmington, Del.

[21] Appl. No.: 823,097

[22] Filed: Aug. 9, 1977

[51] Int. Cl.[2] ..... D05C 3/00

[52] U.S. Cl. ..... 112/266; 28/109; 156/72; 428/95; 428/234; 428/300

[58] Field of Search ..... 112/266, 410, 411; 428/95, 91, 85, 300, 235, 234; 156/148, 72; 28/109, 112

[56] References Cited

U.S. PATENT DOCUMENTS

| | | | |
|---|---|---|---|
| 2,713,012 | 7/1955 | Hartstein | 112/410 |
| 2,866,206 | 12/1958 | Gebert | 112/410 X |
| 3,451,885 | 6/1969 | Klein | 428/235 |
| 3,605,666 | 9/1971 | Kimmel et al. | 112/410 |
| 4,053,668 | 10/1977 | Kimmel et al. | 428/235 X |

FOREIGN PATENT DOCUMENTS

| | | | |
|---|---|---|---|
| 930237 | 7/1963 | United Kingdom | 112/410 |

*Primary Examiner*—H. Hampton Hunter

[57] ABSTRACT

There is disclosed a process for preparing a tufted carpet consisting essentially of feeding simultaneously into a tufting machine a woven or bonded nonwoven sheet of continuous polypropylene filaments and a dyeable, bonded, nonwoven sheet of continuous synthetic organic filaments, said sheets being fed in surface contact with each other, and tufting a pile yarn through both sheets to develop a tufted face having tufts extending above the dyeable, bonded, nonwoven sheet, said pile yarn being selected so as to be dyeable in conjunction with the dyeable, bonded, nonwoven sheet.

5 Claims, 1 Drawing Figure

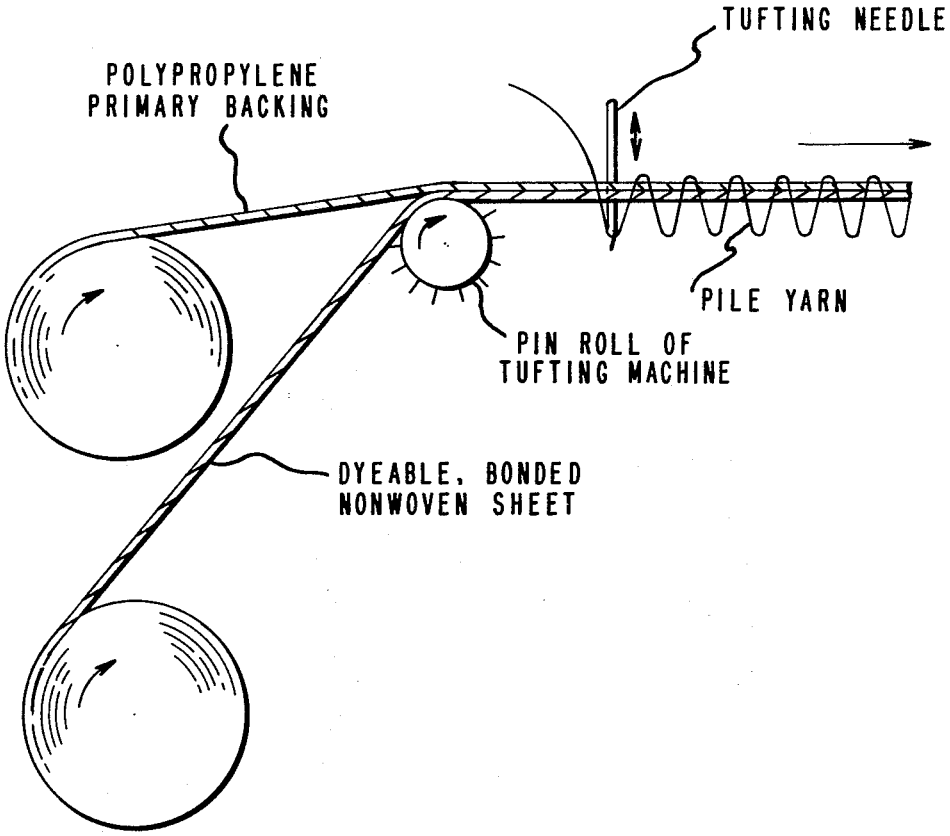
TUFTING NEEDLE
POLYPROPYLENE
PRIMARY BACKING
PILE YARN
PIN ROLL OF
TUFTING MACHINE
DYEABLE, BONDED
NONWOVEN SHEET

PROCESS FOR PREPARING TUFTED CARPET

BACKGROUND OF THE INVENTION

This invention is related to an improved process for making a tufted carpet having high tensile and tear strengths and in which the pile yarn and upper surface of the carpet backing are both dyeable.

Woven and nonwoven sheets of polypropylene are used in the carpet industry as primary backing for tufted carpets. The woven sheets are usually made from continuous polypropylene ribbon filaments which are sometimes fibrillated. The nonwoven carpet backings are made from continuous polypropylene filaments of textile denier. It is well known that polypropylene backings, although otherwise desirable, are not readily dyeable. U.S. Pat. No. 3,605,666, issued to Kimmel et al. on Sept. 20, 1971, is directed to this dyeability problem and discloses a tufted carpet with a compatibly dyeable upper surface made by needling a layer of staple, unbonded fibers onto one surface of a scrim and tufting a yarn through the scrim and the layer of staple fibers. While attractive carpets can be made by the disclosed process, difficulties are encountered when for economical reasons carded webs of low basis weight, i.e., 13 to 30 g/m$^2$, are used for the layer of staple fibers. These low basis weight carded webs tend to fall apart when handled, provide poor cover, and may even have open holes. In addition, the needling operation greatly reduces the tear strength of the tufted, pile carpet produced from the backing.

U.S. Pat. No. 3,983,028, issued to Cole on May 9, 1961, discloses a tufted carpet made by tufting a yarn through a backing member and a bracing web which are held a spaced distance apart. Suitable bracing members disclosed therein include nonwoven fabrics, woven and knitted fabrics. The tufted carpet is said to have better compressional properties and is more adaptable to dyeing when employing nylon in both the bracing member and pile yarn. The Cole process requires that the tufting machine be equipped with an auxiliary needle plate placed at a desired distance from the conventional needle plate. Commercial tufting machines do not have such an auxiliary plate. Moreover, traditional carpet styles, such as those with low pile height, are not easily made on the modified tufting machine described by Cole.

A need still exists for improved processes for preparing from a polypropylene backing, a tufted carpet having high tensile strength, high tear strength, a readily dyeable pile and a readily dyeable upper surface of the backing.

SUMMARY OF THE INVENTION

The present invention provides a process for preparing a tufted carpet which consists essentially of feeding simultaneously into a tufting machine a woven or bonded nonwoven sheet of continuous polypropylene filaments and a dyeable, bonded, nonwoven sheet of continuous synthetic organic filaments, said sheets being fed in surface contact with each other, and tufting a pile yarn through both sheets to develop a tufted face made of tufts extending above the dyeable, bonded, nonwoven sheet; the pile yarn being selected so as to be dyeable in conjunction with the dyeable, bonded, nonwoven sheet.

DETAILED DESCRIPTION OF THE INVENTION

The primary polypropylene carpet backing used in the process of the invention can be a woven or nonwoven material. The woven material can be constructed of continuous ribbon filaments and should have an adequate number of warp ends and filling picks per cm to give good construction, i.e., construction adequate to prevent significant yarn slippage. The nonwoven, polypropylene backing can be a sheet prepared from segment-drawn, continuous, isotactic polypropylene filaments as described in U.S. Pat. No. 3,502,538, issued to Petersen on Mar. 24, 1970. Segment-drawn filaments have alternating drawn and undrawn portions along the length of each filament. Alternatively, the nonwoven backing can be a sheet prepared from mixtures of highly oriented and less oriented continuous filaments of isotactic polypropylene. Preferably, the woven or bonded nonwoven sheet of polypropylene has a basis weight of from about 70–140 g/m$^2$.

In the process of the invention there is used an upper layer of material which will appear above the primary backing in the finished tufted carpet. The upper layer is a dyeable, bonded, nonwoven sheet of continuous synthetic organic filaments which is preferably a lightweight sheet. The term "lightweight" as used herein with respect to the upper layer means a basis weight of from about 13 to 30 g/m$^2$. Suitable materials include polyester nonwovens, such as "Reemay" spunbonded material, a product of E. I. duPont de Nemours and Co., Inc., and polyamide nonwovens, such as "Cerex" nonwoven which is made by the Monsanto Co. The dyeable, bonded, nonwoven sheet can be made of modified polyester having acidic or basic groups for dyeability with cationic or acid dyes, respectively. Bonding of the sheet used in the upper layer can be effected by thermal treatment, by solvent treatment or by the application of adhesive resins using well-known techniques. The sheet is bonded sufficiently to provide a trapezoid tear strength of at least 15 g//g/m$^2$ and a MD (machine direction) stretch of less than 5% . Lightweight sheets meeting these requirements are adequately cohesive and rigid so that they can be fed through the tufting machine without wrinkling.

The pile yarn used in the process of the invention can either be staple spun yarn or continuous filament, crimped yarn and is selected so as to be dyeable in conjunction with the dyeable, bonded, nonwoven sheet. The carpet prepared by the process of the invention can be dyed with a dye which is suitable for dyeing both the pile yarn and the dyeable upper layer of the carpet backing. Alternatively, the pile yarn and the dyeable upper layer can each be dyed with a dye which is separately suitable for each. The dyes can be selected to give the same depth and hue, i.e., union dyeing, or to give contrasting shades between the pile yarn and the dyeable upper layer (cross dyeing). In carpets of low pile weight where a comparable depth and hue is desired in the pile and in the dyeable upper layer, the pile yarn is preferably of the same chemical composition as the dyeable upper layer so that the pile and dyeable upper layer can be dyed with the same dyes. If the pile yarn is a polyamide material and the dyeable, bonded, nonwoven sheet is a polyamide nonwoven, then both are dyeable with acid, direct, dispersed or metallized dyes. If both the pile yarn and the upper layer are composed of polyester material, then both are dyeable with disperse dyes. If the pile yarn is a polyamide and the dyeable, bonded, nonwoven sheet is composed of a polyester material, both can be dyed with disperse dyes; however, for this combination there may be differences in depth, and it may be necessary to use different dyes for the polyamide pile yarn and polyester upper layer if the same depth and hue are desired. These differences in depth may be attractive in some end uses.

Understanding of the process of the invention will be facilitated by reference to the attached drawing.

In the process of the invention the primary backing of polypropylene as described hereinbefore, which forms the bottom layer of the tufted carpet, and the dyeable, bonded, nonwoven sheet of continuous synthetic organic filaments are fed simultaneously into a tufting machine in surface contact with each other, i.e., the adjacent faces of the two sheets touch each other. The primary backing of polypropylene and the dyeable, bonded, nonwoven sheet can be fed from separate rolls to the pin roll of the tufting machine or can be wound together on a single roll in a separate unrelated operation, e.g. during tentering, and later fed from this single roll to the pin roll of the tufting machine.

Generally, since in a conventional tufting machine the tufting needles enter the backing material from above, the dyeable, bonded, nonwoven sheet will be fed into the tufting apparatus on the underside of the primary backing. A pile yarn is then tufted through both sheets to form loops of yarn on the underside of the composite backing. When the tufted carpet so prepared is placed in an upright position, the dyeable, bonded, nonwoven sheet and the tufts extending above it form the tufted face of the carpet.

The process of the invention provides a method of making a tufted carpet from a primary backing of polypropylene having high tensile and tear strength whereby diminution of such high strength by a separate needling step, such as that used when dyeable staple fibers are needled to the upper surface of the backing, is avoided while at the same time the upper surface of the carpet backing is rendered dyeable.

As used herein, tufted tongue tear strength of a carpet is determined according to the method described in column 10, lines 18–41 of U.S. Pat. No. 3,563,838, issued to Edwards on Feb. 16, 1971. The tufted grab tensile strength of a carpet is determined according to the procedure described in column 6, lines 64–73 of U.S. Pat. No. 3,502,538, issued to Petersen on Mar. 24, 1970. The trapezoid tear strength of a sheet used as the dyeable upper layer of the carpet backing of the invention is determined by the method described in Federal Specification CCC-T-1916, Method 5136.

The percent MD (machine direction) stretch of the dyeable, upper-layer sheet is determined with a rectangular sample cut 300 mm long in the machine direction of the sheet and 76 mm wide in the cross direction (XD) of the sheet. The sample is suspended lengthwise from a clamp which extends at least the entire width of the sample. A similar clamp is attached to the sample 254 mm from the first clamp and a total load of 1520 g is applied through the second clamp. From the length before and after loading, the percent change is calculated and reported as percent MD stretch.

The invention is further illustrated by the following examples.

EXAMPLE 1, CONTROL SAMPLE A

A nonwoven, thermally bonded sheet of isotactic polypropylene prepared from segment-drawn filaments is fed from a roll to the feed pin roll of a tufting machine. Simultaneously therewith a bonded nonwoven sheet of polyester was fed from another roll to the same feed pin roll on the tufting machine. The bonded, polyester, nonwoven sheet is fed underneath the nonwoven polypropylene sheet. The nonwoven polypropylene sheet used in this example and for Control Sample A has a basis weight of 119 g/m$^2$, a trapezoid tear strength of 190 g//g/m$^2$ and a MD stretch of 0.2%. The polyester sheet has a basis weight of 20 g/m$^2$, a trapezoid tear strength of 100 g//g/m$^2$, and a MD stretch of 1.5% and contained 88% by weight of polyethylene terephthalate and 12% by weight of polyethylene terephthalate/polyethylene isothalate (80/20 weight % ratio) copolyester filaments.

Using a bulked, continuous filament yarn of 6,6-nylon with a denier of 2600, the combined backing is tufted so that the needles penetrate both sheets and loops of yarn are formed on the underside of the bonded nonwoven sheet of polyester. The tufting needles are spaced apart 4 mm from center to center and are made to penetrate the backing material at a rate sufficient to provide 3.1 stitches per cm. The backing is tufted in a high/low loop construction with a high pile height of 9.5 mm and a low pile height of 4.5 mm.

The resulting carpet is dyed in a beck. The dye bath is first prepared at 27° C. (80° F.) with the following ingredients based on the weight of dyeable fiber:

0.25% antifoam agent
0.5% surface-active agent
1.0% sodium alkyl diaryl sulfonate, a dyeing assistant
1.0% trisodium phosphate
0.5% sequestering agent
2.0% Merpacyl Blue 2GA, an acid dye.

The pH of the dye bath is adjusted to 5.5–6.0 with acetic acid and the bath is heated to raise its temperature to 77° C. (170° F.). Next 4% by weight (based on the weight of dyeable fiber) of "Carolid" 3F, a dye carrier, is added and the pH of the bath is again adjusted to from about 5.5–6.0. "Carolid" 3F is a nonionic emulsifiable biphenyl derivative sold by the Tanatex Chemical Company. Finally, 0.5% by weight (based on the weight of dyeable fiber) of Latyl Blue LS, a disperse dye, is added. The carpet is added to the bath at 77° C. (177° F.); the beck reel is started; and the bath temperature is raised to the boiling point of the bath. Dyeing is continued for one hour at the boiling point temperature. The dye beck solution is drained off and the dyed carpet is rinsed with water to remove residual dye and carrier. The dyed tufted carpet is then dried. The resulting dyed carpet displays a good shade match between the pile yarn and the upper layer of the backing and has good tufted tongue tear and tufted grab tensile properties.

A comparison carpet sample is similarly prepared; however a dyeable upper layer is not employed. The carpet sample, Control Sample A, has high tufted tongue tear and grab tensile properties but the backing is not dyeable. After the pile yarn has been dyed, the uncolored backing is objectionably visible ("grins through") when the carpet is bent as on a staircase. Properties of the resulting carpet samples are given in the table.

EXAMPLE 2

Using a procedure similar to that described in Example 1 a carpet sample is prepared by using a solvent-bonded, polyamide, nonwoven sheet of continuous filaments as the upper layer. This sheet had a basis weight of 20 g/m$^2$, a trapezoid tear strength of 125 g//g/m$^2$ and a MD stretch of 1%. The resulting carpet is dyed with acid dyes using a procedure similar to that described in Example 1 except that a carrier and disperse dye are not used. A good shade match between the pile yarn and the upper layer of the backing is obtained. The properties of the resulting carpet are given in the table.

CONTROL SAMPLE B

Using a thermally bonded nonwoven sheet of isotactic polypropylene filaments similar to that described in Example 1, a prior art product is prepared by needling a batt of staple fibers of 6,6-nylon thereto. The batt has a basis weight of 84 g/m$^2$, a trapezoid tear strength of less than 0.1 g//g/m$^2$ and breaks when measured for MD stretch. The resulting composite backing is tufted with a pile yarn using a procedure similar to that described in Example 1 (except that the composite backing was fed from one roll to the tufting machine) to provide a carpet which is then acid dyed using a procedure similar to that of Example 2. The pile yarn and the upper face of the carpet are readily dyeable but the resulting carpet has poor tufted tongue tear and tufted grab tensile strength per unit weight.

EXAMPLES 3 AND 4 AND CONTROL SAMPLES C AND D

In these experiments a commercially available, woven, polypropylene fabric of continuous ribbon filament is used as the base layer of the carpet backing. The woven fabric has a basis weight of 109 g/m$^2$, a trapezoid tear strength of 250 g//g/m$^2$ and a MD stretch of 0.5%. In Example 3 the upper layer is a thermally bonded, nonwoven sheet of continuous polyester filaments having properties similar to the sheet used in Example 1. In Example 4 the upper layer of the carpet backing is a solvent-bonded, nonwoven sheet of polyamide continuous filaments having properties similar to the sheet used in Example 2. In each example the upper and base layers were simultaneously tufted with a pile yarn using a procedure similar to that described in Example 1 to produce a carpet which was then dyed. In Example 3 the dyeing procedure was similar to that described in Example 1 and in Example 4 the dyeing procedure was similar to that described in Example 2. The resulting carpets have good tensile properties and display good shade match between pile yarn and the upper face of the backing.

A sample, Comparison Sample C, of the woven, polypropylene, ribbon fabric having no upper layer is similarly tufted with a pile yarn and dyed. After dyeing, the carpet backing is objectionably visible when the carpet sample is bent because the backing did not dye.

A prior art sample, Comparison Sample D, is prepared by needling a batt of 6,6-nylon staple fibers to a layer of woven polypropylene ribbon fabric. The batt of staple fibers has a basis weight of 68 g/m$^2$, a trapezoid tear strength of less than 0.1 gl/g/m$^2$ and breaks when measured for MD stretch. A carpet sample is prepared from the composite backing by tufting a pile yarn therethrough. The pile yarn is similar to that described in Example 1 and the tufting procedure is similar to that described in Example 1 except that the composite backing had been formed prior to tufting. The resulting carpet is compatibly dyeable but has poor carpet properties. Carpet properties for the carpets prepared in Examples 3 and 4 and Control Samples C and D are given in the table.

TABLE

| | Properties of Carpets After Dyeing | | |
|---|---|---|---|
| | Basis Weight of Composite Backing, g/m$^2$ | Tufted Tongue Tear Strength, g//g/m$^2$ | Tufted Grab Tensile, g/cm//g/m$^2$ |
| Example 1 | 139 | 99 | 94 |
| Comparison Sample A | 119 | 107 | 107 |
| Example 2 | 139 | 91 | 81 |
| Comparison Sample B | 203 | 49 | 43 |
| Example 3 | 129 | 197 | 95 |
| Example 4 | 129 | 175 | 110 |
| Comparison Sample C | 109 | 188 | 113 |
| Comparison Sample D | 177 | 95 | 71 |

I claim:

1. A process for preparing a tufted carpet consisting essentially of feeding simultaneously into a tufting machine a primary carpet backing of continuous polypropylene filaments, said primary backing being selected from the group consisting of woven material and bonded nonwoven material, and a dyeable, bonded nonwoven sheet of continuous synthetic organic filaments, said sheet having a basis weight of 13 to 30 g/m$^2$, a trapezoid tear strength of at least 15 g//g/m$^2$ and a MD stretch of less than 5%, said primary backing and said dyeable, bonded sheet being fed in unconnected surface contact with each other, and tufting a pile yarn through said backing and said sheet to develop a tufted face having tufts emerging from and extending beyond the dyeable, bonded, nonwoven sheet, said pile yarn being selected so as to be dyeable in conjunction with said dyeable, bonded, nonwoven sheet.

2. The process of claim 1 wherein the sheet of continuous polypropylene filaments is a bonded nonwoven sheet.

3. The process of claim 2 wherein the sheet of continuous polypropylene filaments has a basis weight of from about 70–140 g/m$^2$.

4. The process of claim 1 wherein the sheet of continuous polypropylene filaments is a woven sheet of continuous ribbon filaments.

5. The process of claim 4 wherein the sheet of continuous polypropylene filaments has a basis weight of from about 70–140 g/m$^2$.

* * * * *